US007143749B1

(12) United States Patent
Colletti

(10) Patent No.: US 7,143,749 B1
(45) Date of Patent: Dec. 5, 2006

(54) APPARATUS AND METHOD FOR SECURING A FUEL RAIL TO AN ENGINE

(75) Inventor: Michael J. Colletti, Churchville, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/243,536

(22) Filed: Oct. 5, 2005

(51) Int. Cl.
*F02M 55/02* (2006.01)

(52) U.S. Cl. ..... 123/469

(58) Field of Classification Search ..... 123/469
See application file for complete search history.

(56) References Cited

U.S. PATENT DOCUMENTS 5,408,971 A * 4/1995 Jaeger et al. ..... 123/469
6,148,798 A 11/2000 Braun et al.
6,186,118 B1 2/2001 Spakowski
6,269,804 B1 8/2001 Braun et al.
6,340,019 B1 1/2002 Eshleman et al.
6,345,606 B1 2/2002 Ricci-Ottati et al.
6,513,500 B1 2/2003 Braun et al.
6,532,939 B1 * 3/2003 Ozeki ..... 123/469
6,604,413 B1 8/2003 Panek et al.
6,626,152 B1 9/2003 Deangelis et al.
6,640,783 B1 11/2003 Braun et al.
6,655,354 B1 12/2003 Curran et al.
6,732,711 B1 * 5/2004 Yanagii ..... 123/469
6,732,717 B1 5/2004 Braun et al.
6,736,111 B1 5/2004 Braun et al.
6,802,297 B1 10/2004 Braun et al.
6,871,635 B1 3/2005 Curran et al.
6,901,914 B1 6/2005 Becene et al.

* cited by examiner

*Primary Examiner*—Noah Kamen
(74) *Attorney, Agent, or Firm*—Paul L. Marshall

(57) ABSTRACT

Apparatus and method for securing a fuel rail to a cylinder head of an engine wherein a plurality of passageways are formed through the fuel rail perpendicular to the longitudinal axis thereof. Securing members (e.g., bolts) are passed through the passageways and secured directly to the cylinder head. The bolts and injector sockets are preferably arranged in linearly spaced, alternating fashion along the fuel rail and lie along a common plane that intersects the longitudinal axis of the fuel rail.

22 Claims, 6 Drawing Sheets

APPARATUS AND METHOD FOR SECURING A FUEL RAIL TO AN ENGINE

TECHNICAL FIELD

The present invention relates to fuel injector rails for internal combustion engines; more particularly, to an apparatus and method for securing the fuel rail to the engine.

BACKGROUND OF THE INVENTION

Fuel injectors for controllably metering fuel to the combustion cylinders of internal combustion engines are well known. Modern engines typically incorporate a dedicated fuel injector for each cylinder, the fuel injector being disposed in the intake port or runner from the intake manifold to the cylinder. For ease and reliability in manufacturing, the fuel injectors typically are mounted by their inlet ends at appropriate intervals into a rigid fuel supply line harness, appropriately configured to place the injection end of each fuel injector into its corresponding injection socket in the manifold runner. Such a harness is known as a fuel injector rail, or simply a fuel rail.

In a typical direct injector fuel injection system, each injector is programmed to pulse or open every other revolution of the engine crankshaft. During an injector opening event in a direct injector fuel injection system, the measured fuel pressure in the fuel rail can instantaneously drop by more than 30 kPa, then can increase by more than 50 kPa after the injector closes. For a typical four cylinder engine operating at 2000 RPM, the combined injectors pulse at a rate of 66 pulses per second. In such injector-based systems, these pulses, dropping then raising the pressure in the rail, cause high frequency pressure waves of significant amplitude to propagate through the fuel rail(s) potentially causing erratic delivery of fuel to the cylinders. This condition is aggravated even further in an Air Pressure Direct Injector (APDI) system where a pair of injectors (which separate the fuel metering event from the fuel delivery event) firing out of phase, each at 66 pulses per second, induce pressure pulsations into the fuel rails.

The fuel rails themselves are typically bolted to the cylinder head. In one prior art method seen in FIG. 1, the fuel rail 10 is laterally offset from the position of the bolts (not shown) which are secured to the cylinder head (also not shown) through brackets 12. The fuel rail 10 is offset so the bolts are accessible when attaching or removing the fuel rail from the cylinder head. In this embodiment, the brackets 12 extend around a respective fuel injector socket 14, into which the inlet ends of the injectors (not shown) are placed. This prior art design requires a jumper tube 16 leading from the rail 10 to the respective socket 14. It also requires additional brackets 18 positioned on the side of the rail opposite the socket side to firmly secure the rail in place on the cylinder head. This prior art method has several serious drawbacks. First, the brackets require very tight tolerances due to the high pressure forces generated by the fuel injectors. Due to the excessive amount of bracketing required in this design, the tolerance stack-up is high and difficult to effectively and consistently control. The prior art design also requires a jumper tube 16 due to the lateral offset of the rail with respect to the injectors. The jumper tubes not only impart additional part cost, but also introduce additional tolerance locations that need to be controlled as well as seals that may leak. It would therefore be desirable to have a method and design for securing a fuel rail to a cylinder head that reduces or eliminates the amount of bracketing required. It would furthermore be desirable to have a method and design for securing a fuel rail to a cylinder head that does not require jumper tubes.

SUMMARY OF THE INVENTION

The present invention addresses the above needs by providing a method and design for firmly securing a fuel rail to a cylinder head in which bracketing and jumper tubes are not needed. In a preferred embodiment, a fuel rail is provided that includes a plurality of passages extending perpendicularly and completely through the fuel rail such that each passageway is open at both ends. A bolt may be passed through the top opening until the head thereof abuts the perimeter of the top opening and the end of the bolt shank extends out from the other side of the same opening. The exposed end of the bolt shank is threaded or otherwise secured directly into the cylinder head, thereby securing the fuel rail to the cylinder head without any bracketing. Each passage may be in the form of a cylinder that is brazed or otherwise attached to the fuel rail in a fluid-tight manner. As such, each passageway provides a fluid-tight conduit through which a respective bolt may pass and be secured to the fuel rail. In the preferred embodiment, the location of the passages and respective bolts are adjacent to and on either side of a respective fuel injector socket. It will be realized that this manner of bolt attachment is extremely effective at keeping the rail from moving under the pressure of the fuel traveling through the rail and injectors.

BRIEF DESCRIPTION OF THE DRAWINGS

The present invention will now be described, by way of example, with reference to the accompanying drawings, in which.

DESCRIPTION OF THE PREFERRED EMBODIMENTS

Figure 1:
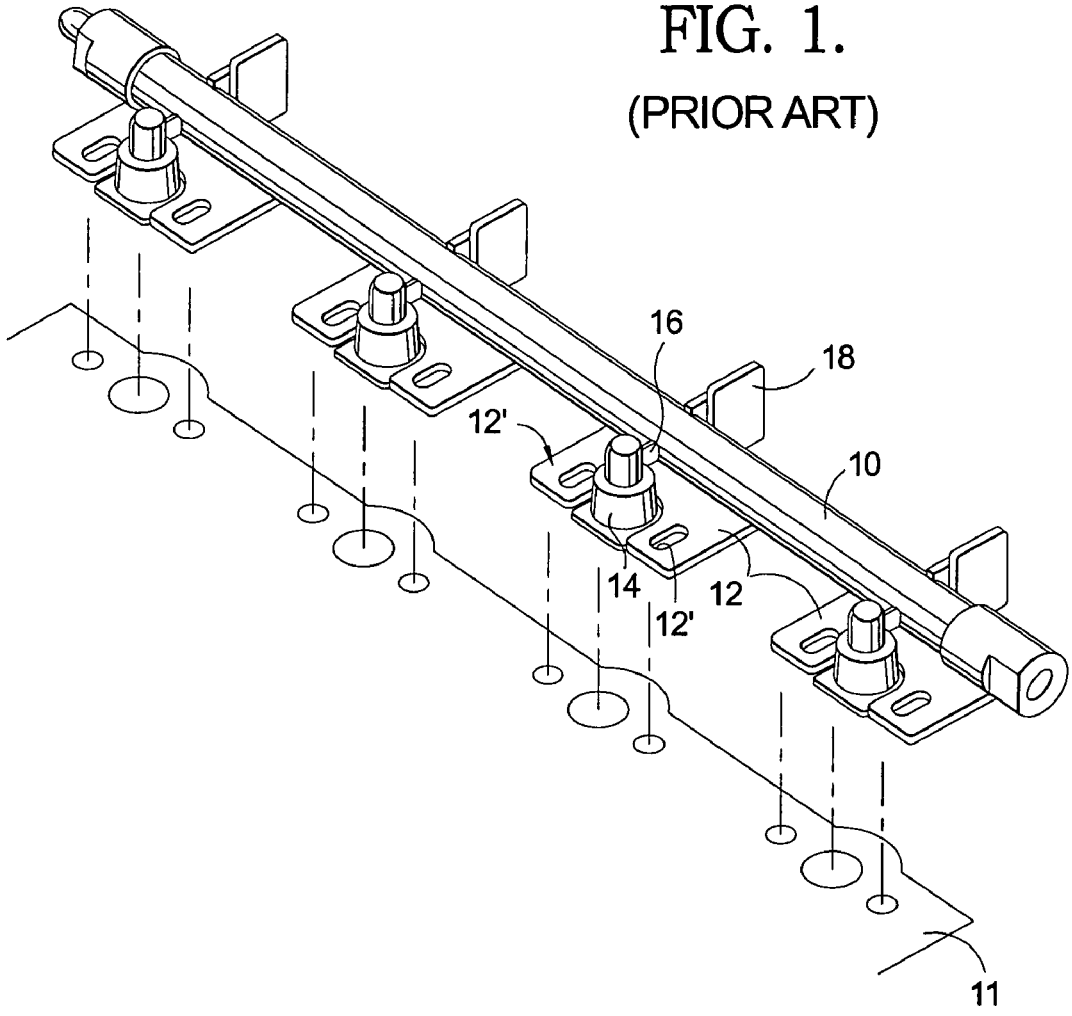
FIG. 1. (PRIOR ART)
FIG. 1 is an isometric view of a prior art fuel rail and associated injector sockets and bracketing.

Referring to FIG. 1, there is seen a prior art method of securing a fuel rail 10 to a cylinder head of an engine (not shown) wherein bracketing 12, 18 secure the fuel rail 10 to the cylinder head 11. The fuel rail 10 is laterally offset from the injector sockets 14 to provide access to the bolts (not shown) which pass through the openings 12' in brackets 12. With the fuel rail 10 laterally offset from the injector sockets 14, jumper tubes 16 are required to provide a fluid path from the rail to a respective injector socket 14. Injector sockets 14 are known in the art and provide a coupling between a respective fuel injector (not shown) and the fuel rail 10. It will be appreciated that the jumper tubes 16 and bracketing 12, 18 introduce tolerance stack-up issues that, if not tightly controlled, will result in a destabilization and movement of the fuel rail 10 under the forces of the fuel passing through the fuel injectors and into the cylinder head 11.

Figure 2:
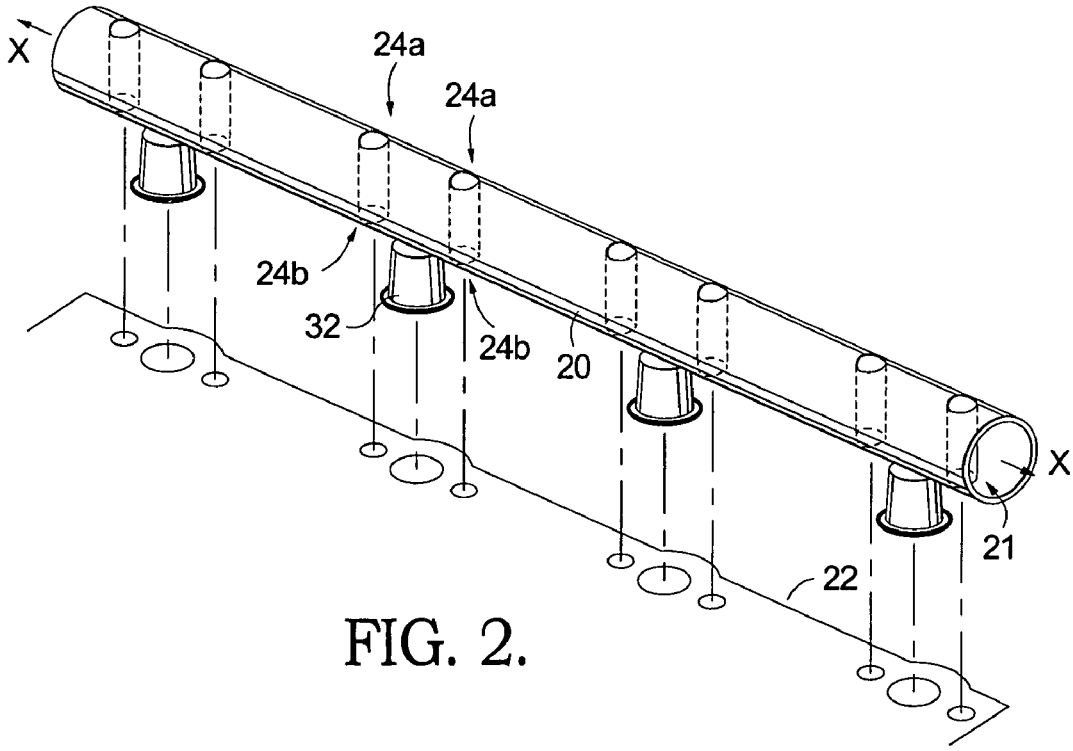
FIG. 2 is a perspective view of a fuel rail and injector sockets according to an embodiment of the invention.
Figure 3:
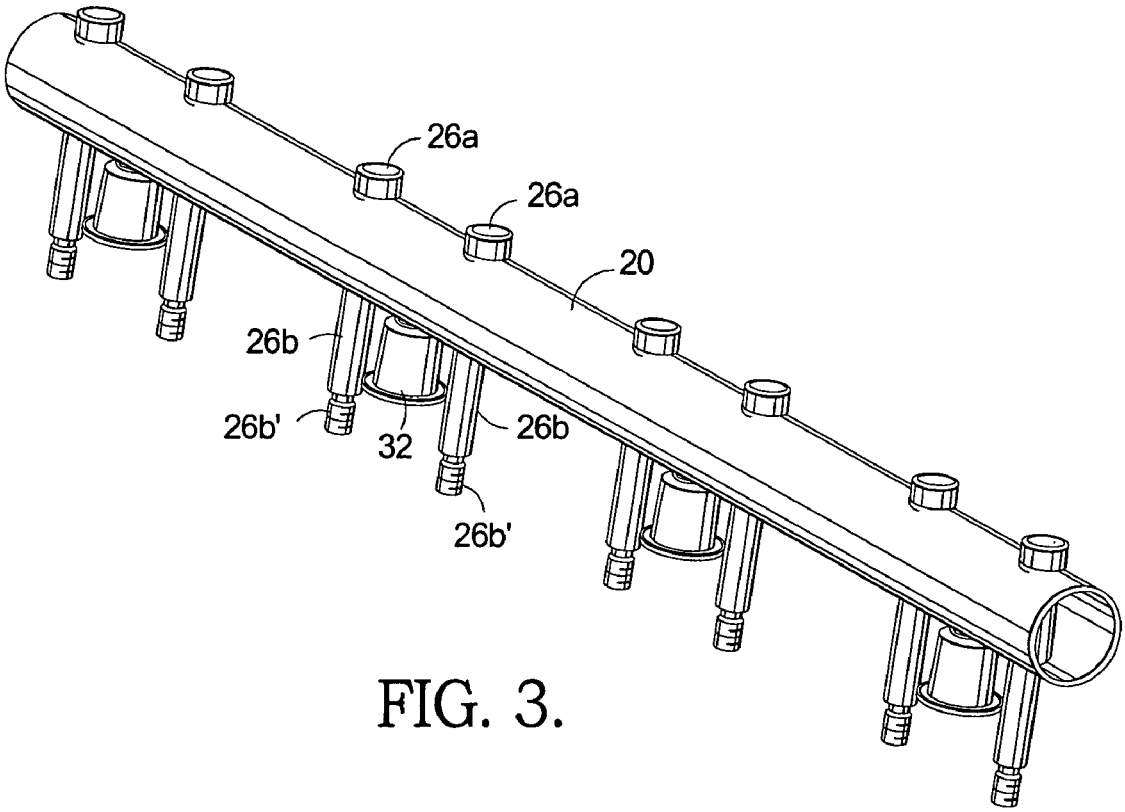
FIG. 3 is the fuel rail of FIG. 2 including the bolts and injector sockets according to an embodiment of the invention.
Figure 4:
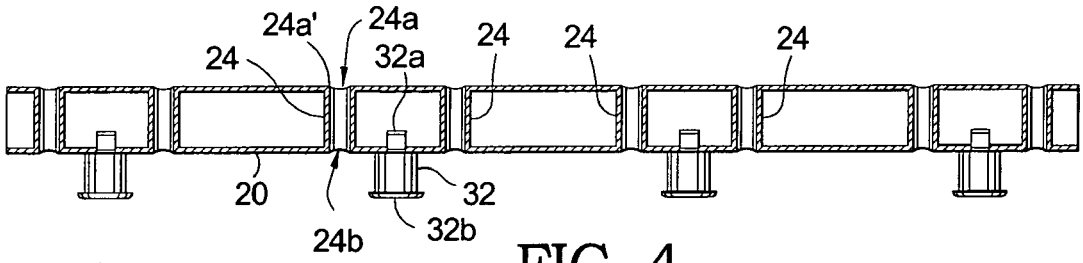
FIG. 4 is an elevational, cross-sectional view as taken generally along the line 4—4 of FIG. 2.

Referring to FIGS. 2–4, a first preferred embodiment of the invention is shown wherein a fuel rail 20 is provided to deliver fuel to the cylinder head 22 of an engine (the entire engine not shown). Fuel rail 20 has a main fuel conduit 21 extending along a longitudinal axis X—X and further includes a plurality of bolt passageways 24 extending perpendicularly and completely through the fuel rail 20 such that each passageway 24 is open at both ends 24*a*, 24*b* thereof, respectively. A bolt 26 or other suitable securing member may be passed through a respective passageway top opening 24*a* until the head 26*a* thereof abuts the perimeter 24*a*' of the passageway top opening 24*a* and the end 26*b*' of the bolt shank 26*b* extends out from the passageway bottom opening 24*b*. The exposed end 26*b*' of the bolt shank 26*b* is threaded or otherwise secured directly into the cylinder head 30, thereby firmly securing the fuel rail 20 to the cylinder head 30 without any bracketing.

As seen best in FIG. 4, each bolt passageway 24 may be in the form of a cylinder that is brazed or otherwise attached in a fluid-tight manner through aligned holes drilled in the fuel rail (the holes then defining the top and bottom openings 24*a*, 24*b* of the respective passageway 24). As such, each passageway 24 provides a fluid-tight conduit through which a respective bolt 26 may pass and be secured to the cylinder head 30. Since the bolt shank 26*b* is of much smaller dimension than the cross-sectional area of the fuel rail 20, fuel may flow in main conduit 21 around the passageways 24 without restriction.

In the first preferred embodiment, the location of the passageways 24 and respective bolts 26 are adjacent to and on either side of a respective fuel injector socket 32 although this may vary as described further below. Since the fuel rail 20 is bolted directly over the injector sockets 32, the fuel rail 20 is more firmly secured to the cylinder head than in the laterally offset, bracketed manner of the prior art. Furthermore, the bolt heads 26*a* remain accessible for ease of removal and reattachment to the cylinder head as necessary.

Figure 5:
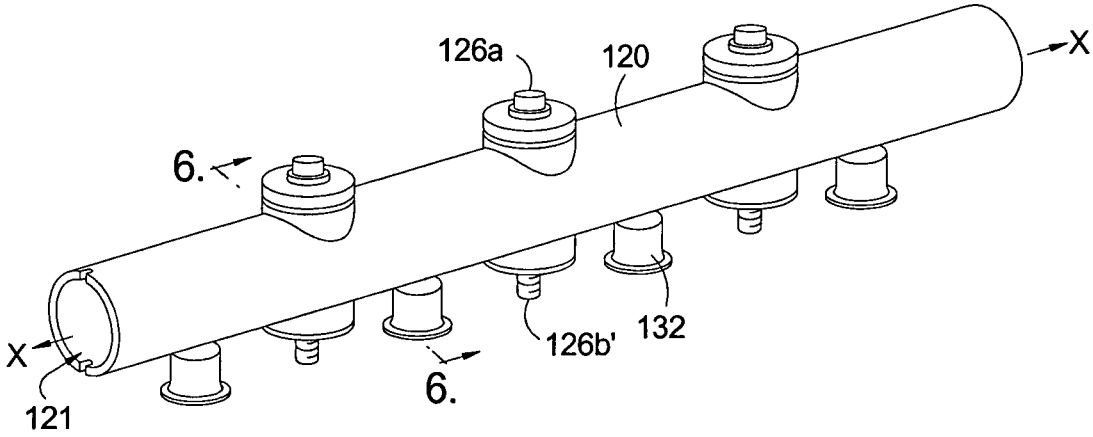
FIG. 5 is a perspective view of an alternate embodiment of the invention.
Figure 6:
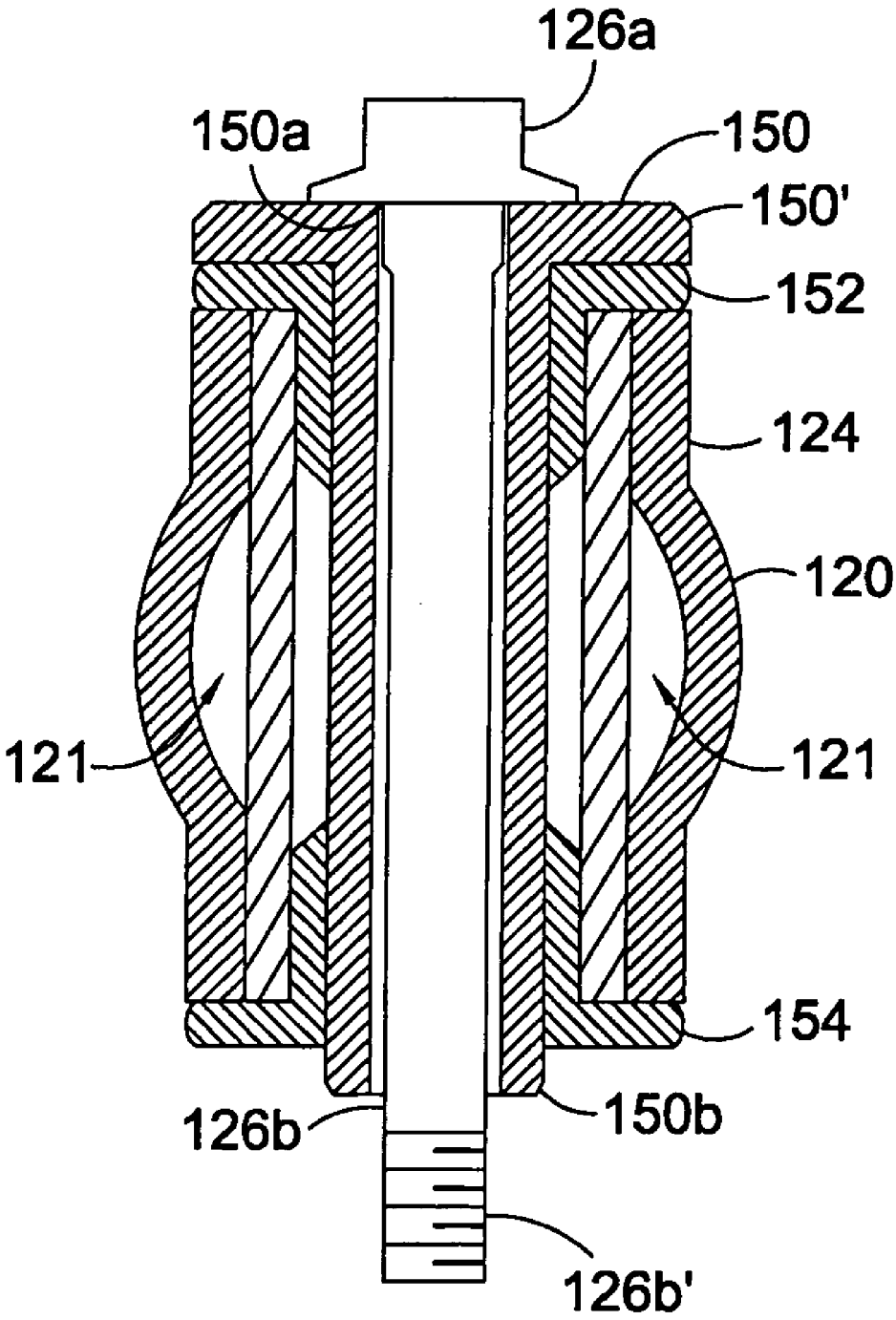
FIG. 6 is a cross-sectional view as taken generally along the line 6—6 of FIG. 5.

FIGS. 5 and 6 show an alternate embodiment of the invention wherein fuel rail 120 includes a main conduit 121 extending along longitudinal axis X—X. In this embodiment, each bolt passageway 124 is formed by an outer cylindrical wall 124 and an inner cylindrical sleeve 150 attached via upper and lower bushings 152, 154, respectively. A bolt 126 or other suitable securing member is passed through sleeve 150 until the bolt head 126*a* is seated on shoulder 150' of sleeve 150, and bolt threaded end 126*b*' extends from sleeve lower opening 150*b*. As seen in FIG. 6, the passageways and injector sockets are arranged in alternating, linearly spaced fashion along said fuel rail in this or any other embodiment of the invention.

In either embodiment of the invention, it will be appreciated that the bolts and injector sockets extend along a common plane which intersects the fuel rail axis X—X. In this way, the fuel rail is positioned directly over the injector sockets (and respective fuel injectors), resulting in an extremely firm attachment arrangement between the fuel rail and cylinder head and without the need for bracketing or jumper tubes.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. Apparatus for securing a fuel rail to a cylinder head comprising:

a) a fuel rail having a main conduit extending along a longitudinal axis;

b) a plurality of fluid-tight passageways formed entirely through said main conduit of said fuel rail and extending substantially perpendicular to said longitudinal axis; and c) a plurality of securing members for passing through said plurality of fluid-tight passageways, respectively, wherein said securing members may be attached to said cylinder head and thereby secure said fuel rail to said cylinder head.

2. The apparatus of claim 1, and further comprising a plurality of injector sockets attached to said fuel rail.

3. The apparatus of claim 2 wherein said injector sockets and said passageways are linearly spaced along said fuel rail.

4. The apparatus of claim 3 wherein a pair of said passageways are located adjacent to and on either side of a respective said passageway.

5. The apparatus of claim 3 wherein said passageways and said injector sockets are arranged in alternating, linearly spaced fashion along said fuel rail.

6. The apparatus of claim 2 wherein said securing members and said injector sockets extend along the same plane.

7. The apparatus of claim 6 wherein said plane intersects said longitudinal axis of said fuel rail.

8. The apparatus of claim 1 wherein each of said passageways is defined by a cylinder passing through said fuel rail substantially perpendicular to said longitudinal axis.

9. The apparatus of claim 8 wherein each of said cylinders is brazed to said fuel rail.

10. The apparatus of claim 1 wherein each of said passageways is defined by an outer cylindrical wall and an inner cylindrical sleeve attached to the outer cylindrical wall via upper and lower bushings.

11. The apparatus of claim 1 wherein said securing members are bolts.

12. A method of securing a fuel rail to a cylinder head, said method comprising the steps of:

a) providing a fuel rail having a main conduit extending along a longitudinal axis;

b) providing a plurality of linearly spaced passageways in said main conduit of said fuel rail, said passageways extending substantially perpendicular to said longitudinal axis;

c) passing a plurality of securing members through said plurality of passageways, respectively; and d) securing said securing members to said cylinder head.

13. The method of claim 12, wherein said securing members are bolts.

14. The method of claim 12, and further comprising the step of attaching a plurality of injector sockets to said fuel rail.

15. The method of claim 14 wherein said injector sockets and said passageways are linearly spaced along said fuel rail.

16. The method of claim 15 wherein a pair of said passageways are located adjacent to and on either side of a respective said passageway.

17. The method of claim 15 wherein said passageways and said injector sockets are arranged in alternating, linearly spaced fashion along said fuel rail.

18. The method of claim 14 wherein said securing members and said injector sockets extend along a common plane.

19. The method of claim 18 wherein said plane intersects said longitudinal axis of said fuel rail.

20. The method of claim 12 wherein each of said passageways is defined by a cylinder passing through said fuel rail substantially perpendicular to said longitudinal axis.

21. The method of claim 20 and further comprising the step of brazing each of said cylinders to said fuel rail.

22. The method of claim 12 wherein each of said passageways is defined by an outer cylindrical wall and an inner cylindrical sleeve attached to the outer cylindrical wall via upper and lower bushings.

* * * * *